US010233645B2

(12) United States Patent
Izumi et al.

(10) Patent No.: US 10,233,645 B2
(45) Date of Patent: Mar. 19, 2019

(54) METAL ROOFING MEMBER, AND ROOFING STRUCTURE AND ROOFING METHOD USING SAME

(71) Applicant: NISSHIN STEEL CO., LTD., Tokyo (JP)

(72) Inventors: Keiji Izumi, Ichikawa (JP); Yuugo Oota, Ichikawa (JP); Tomoyuki Nagatsu, Ichikawa (JP); Norimasa Miura, Sakai (JP); Katsunari Norita, Sakai (JP); Kenichi Okubo, Ichikawa (JP)

(73) Assignee: NISSHIN STEEL CO., LTD., Tokyo (JP)

( * ) Notice: Subject to any disclaimer, the term of this patent is extended or adjusted under 35 U.S.C. 154(b) by 0 days.

(21) Appl. No.: 15/560,223

(22) PCT Filed: Jul. 8, 2015

(86) PCT No.: PCT/JP2015/069638

§ 371 (c)(1),
(2) Date: Sep. 21, 2017

(87) PCT Pub. No.: WO2016/157556

PCT Pub. Date: Oct. 6, 2016

(65) Prior Publication Data

US 2018/0080228 A1 Mar. 22, 2018

(30) Foreign Application Priority Data

Mar. 27, 2015 (JP) ..... 2015-066825
Jun. 8, 2015 (JP) ..... 2015-115696

(51) Int. Cl.
*E04D 1/30* (2006.01)
*E04D 3/30* (2006.01)
(Continued)

(52) U.S. Cl.
CPC ..... *E04D 3/30* (2013.01); *C23C 2/06* (2013.01); *C23C 2/12* (2013.01); *C23C 18/31* (2013.01);
(Continued)

(58) Field of Classification Search
CPC ..... E04D 3/30; E04D 3/352
See application file for complete search history.

(56) References Cited

U.S. PATENT DOCUMENTS 3,479,784 A * 11/1969 Massagli ..... E04C 2/292 160/235
3,535,844 A * 10/1970 Glaros ..... E04C 2/296 52/309.9
(Continued)

FOREIGN PATENT DOCUMENTS

JP 01-158165 A 6/1989
JP 10-238073 9/1998
(Continued)

OTHER PUBLICATIONS

International Search Report cited in PCT/JP2015/069638 dated Aug. 18, 2015, 2 pages.
(Continued)

*Primary Examiner* — Paola Agudelo
(74) *Attorney, Agent, or Firm* — Rothwell, Figg, Ernst & Manbeck, P.C.

(57) ABSTRACT

A metal roofing member 1 has a front substrate 10, a rear substrate 11 and a core material 12. The front substrate 10 is made of a metal sheet. In the front substrate 10, a box-shaped body portion 100 and a flange portion 110 extending from the body portion 100 are provided. The flange portion 110 is formed by folding back, over the rear side of the front substrate 10, of a metal sheet 111 extending outwards of the body portion 100 in a direction **100*b*** perpendicular to a
(Continued)

height direction 100*a* of the body portion 100, from a lower edge of the body portion 100, in such a manner that the metal sheet 111 wraps around the rear substrate 11. The metal roofing member 1 is disposed on a roof base, with the flange portion 110 butting against a flange portion 110 of another metal roofing member.

15 Claims, 4 Drawing Sheets

(51) Int. Cl.

| | |
|---|---|
| ***E04D 1/18*** | (2006.01) |
| ***E04D 1/28*** | (2006.01) |
| ***C23C 2/06*** | (2006.01) |
| ***C23C 2/12*** | (2006.01) |
| ***C23C 18/31*** | (2006.01) |
| ***E04D 3/35*** | (2006.01) |
| ***E04D 3/36*** | (2006.01) |
| ***E04D 1/24*** | (2006.01) |
| *E04D 1/34* | (2006.01) |

(52) U.S. Cl.

CPC ..... *E04D 1/18* (2013.01); *E04D 1/24* (2013.01); *E04D 1/28* (2013.01); *E04D 3/352* (2013.01); *E04D 3/36* (2013.01); *E04D 2001/3423* (2013.01); *E04D 2001/3452* (2013.01); *E04D 2001/3482* (2013.01); *E04D 2001/3494* (2013.01)

(56) References Cited

U.S. PATENT DOCUMENTS

| | | | | | |
|---|---|---|---|---|---|
| 3,540,116 | A * | 11/1970 | Bohnsack | E04C 2/28 | 156/563 |
| 4,130,975 | A * | 12/1978 | Kelley | E04C 2/08 | 52/546 |
| 4,186,539 | A * | 2/1980 | Harmon | E04B 1/6129 | 52/580 |
| 4,445,305 | A * | 5/1984 | Orie, Sr. | E04D 13/165 | 52/309.9 |
| 4,574,555 | A * | 3/1986 | Cline | B29C 37/0085 | 52/783.1 |
| 5,285,609 | A * | 2/1994 | Goad | E04C 2/292 | 52/588.1 |
| 5,394,672 | A * | 3/1995 | Seem | B32B 15/04 | 52/794.1 |
| 5,709,053 | A * | 1/1998 | Kuroda | B29B 17/0026 | 181/284 |
| 6,314,701 | B1 * | 11/2001 | Meyerson | E04C 2/292 | 52/309.9 |
| 7,107,731 | B2 * | 9/2006 | Record | E04C 2/288 | 52/284 |
| 7,607,271 | B2 * | 10/2009 | Griffin | E04C 2/296 | 52/478 |
| 8,590,251 | B2 * | 11/2013 | Bandera | E04F 13/0876 | 52/545 |

FOREIGN PATENT DOCUMENTS

| | | | |
|---|---|---|---|
| JP | 10-306548 | A | 11/1998 |
| JP | 2002-309752 | A | 10/2002 |
| JP | 2003-074163 | A | 3/2003 |
| JP | 2003-328504 | A | 11/2003 |
| JP | 2013-096057 | | 5/2013 |
| JP | 2013-256773 | | 12/2013 |

OTHER PUBLICATIONS

Extended Search Report issued for European Patent Application No. 15887698.7 on Jun. 20, 2018, 7 pages.

* cited by examiner

METAL ROOFING MEMBER, AND ROOFING STRUCTURE AND ROOFING METHOD USING SAME

CROSS REFERENCE TO RELATED APPLICATION

This application is a 35 U.S.C. 371 National Phase Entry Application from PCT/JP2015/069638, filed Jul. 8, 2015, which claims the benefit of Japanese Patent Application Nos. 2015-066825 filed Mar. 27, 2015 and 2015-115696 filed on Jun. 8, 2015, the disclosure of which are incorporated herein in their entirety by reference.

TECHNICAL FIELD

The present invention relates to a metal roofing member that is disposed side by side with another metal roofing member on a roof base, and to a roofing structure and a roofing method that utilize the metal roofing member.

BACKGROUND ART

Examples of types of such metal roofing members used conventionally include the structure disclosed in PTL 1, among others. Specifically, conventional metal roofing members have a front substrate in which a metal sheet is formed to a box shape. Roofing of a house is carried out by arranging side by side, on a roof base, a plurality of metal roofing members while respective side faces of the front substrates are caused to butt each other.

CITATION LIST

Patent Literature

[PTL 1] Japanese Patent Application Publication No. 2003-74147

SUMMARY OF INVENTION

Technical Problem

The front substrate in such conventional metal roofing members is box-shaped, and accordingly the following problems arise. Specifically, the box-shaped front substrate has a constant thickness with a view to securing functionality as a roofing member. Upon direct mutual butting of side faces of front substrates having such a constant thickness, water such as rainwater becomes pooled in a corresponding amount between the metal roofing members, giving rise to corrosion of the metal roofing members and the roof base.

An object of the present invention, arrived at in order to solve the above problem, is to provide a metal roofing member, and a roofing structure and roofing method that utilize the metal roofing member, that allow reducing water pooled between metal roofing members while allaying the concern of corrosion.

Solution to Problem

The metal roofing member according to the present invention is a metal roofing member disposed side by side with another metal roofing member on a roof base, the metal roofing member including: a front substrate made of a metal sheet, and provided with a box-shaped body portion and a flange portion extending from the body portion; a rear substrate disposed on the rear side of the front substrate, so as to cover an opening of the body portion; and a core material made from a foam resin and filled in between the front substrate and the rear substrate, wherein the flange portion is formed by folding back, over the rear side of the front substrate, of the metal sheet extending outwards of the body portion in a direction perpendicular to a height direction of the body portion, from a lower edge of the body portion, in such a manner that the metal sheet wraps around the rear substrate; the flange portion is provided with a rear end that comes in contact with the roof base; the distance between the rear end of the flange portion and the rear surface of the rear substrate is set to 1 mm to 4 mm; and the flange portion is configured to be disposed on the roof base while butting against a flange portion of the other metal roofing member.

The roofing structure according to the present invention includes a plurality of metal roofing members, each having: a front substrate made of a metal sheet, and provided with a box-shaped body portion and a flange portion extending from the body portion; a rear substrate disposed on the rear side of the front substrate, so as to cover an opening of the body portion; a core material made from a foam resin and filled in between the front substrate and the rear substrate, the flange portion being formed by folding back, over the rear side of the front substrate, of the metal sheet extending outwards of the body portion in a direction perpendicular to a height direction of the body portion, from a lower edge of the body portion, in such a manner that the metal sheet wraps around the rear substrate; the flange portion being provided with a rear end that comes in contact with a roof base; and the distance between the rear end of the flange portion and the rear surface of the rear substrate being set to 1 mm to 4 mm; wherein the plurality of metal roofing members are disposed side by side on the roof base while respective flange portions are caused to butt each other.

The roofing method according to the present invention involves: using a plurality of metal roofing members each having: a front substrate made of a metal sheet, and provided with a box-shaped body portion and a flange portion extending from the body portion; a rear substrate disposed on the rear side of the front substrate, so as to cover an opening of the body portion; and a core material made from a foam resin and filled in between the front substrate and the rear substrate, the flange portion being formed by folding back, over the rear side of the front substrate, of the metal sheet extending outwards of the body portion in a direction perpendicular to a height direction of the body portion, from a lower edge of the body portion, in such a manner that the metal sheet wraps around the rear substrate, the flange portion being provided with a rear end that comes in contact with a roof base, and the distance between the rear end of the flange portion and the rear surface of the rear substrate being set to 1 mm to 4 mm; and arranging the plurality of metal roofing members side by side on the roof base, while causing respective flange portions to butt each other.

Advantageous Effects of Invention

In the metal roofing member, and the roofing structure and roofing method that utilize the metal roofing member of the present invention, the metal roofing members is configured so that the flange portion is disposed on the roof base while butting the flange portion of another metal roofing member, as a result of which a gap is formed between the body portion and the body portion of the other metal roofing member. Therefore, this allows reducing water pooling between metal roofing members, and allaying the concern of corrosion.

DESCRIPTION OF EMBODIMENTS

Embodiments for carrying out the present invention will be explained next with reference to accompanying drawings.

Embodiment 1

Figure 1:
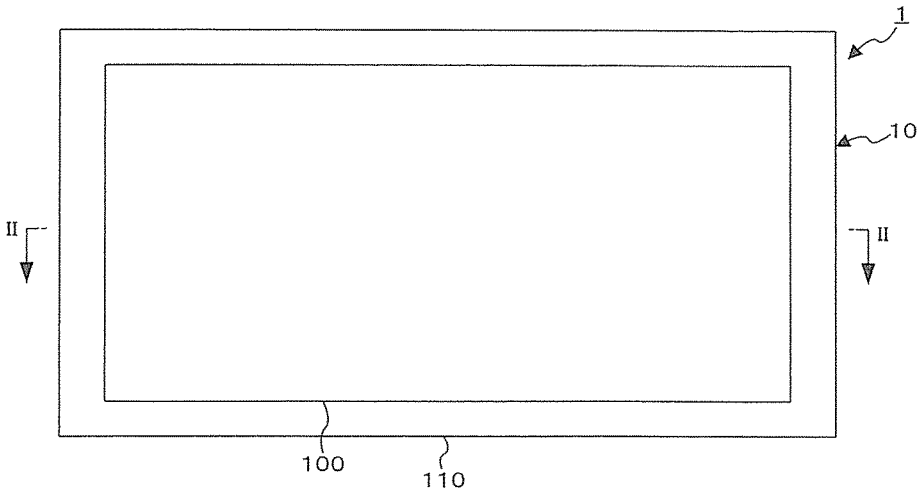
FIG. 1 is a plan-view diagram illustrating a metal roofing member according to Embodiment 1 of the present invention.
Figure 2:
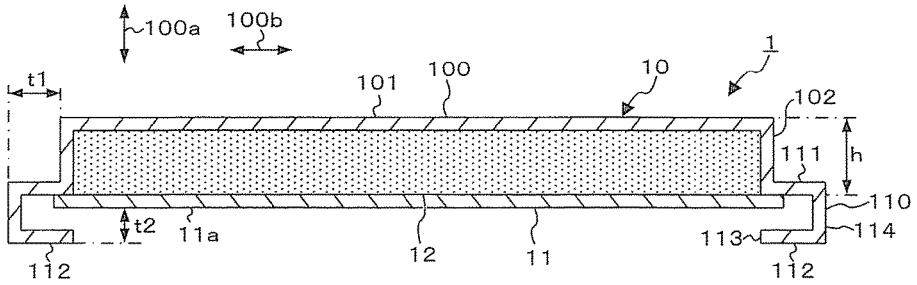
FIG. 2 is a cross-sectional diagram along line II-II in FIG. 1.
Figure 3:
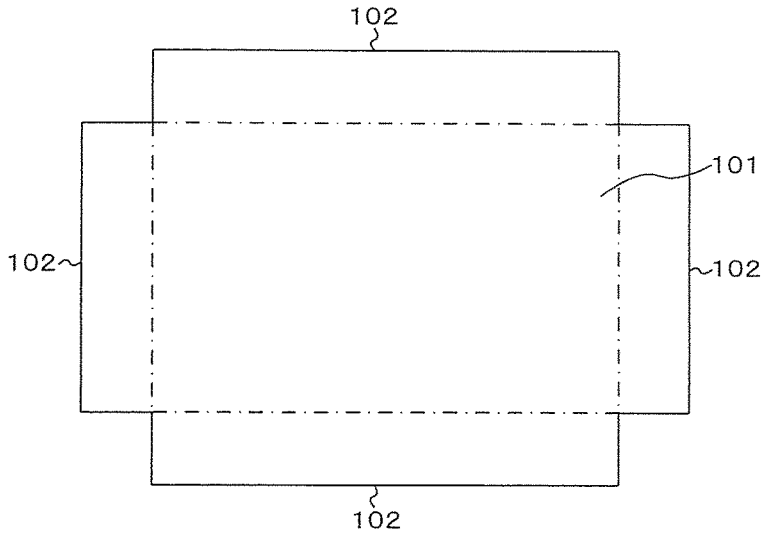
FIG. 3 is an explanatory diagram illustrating another embodiment of a body portion 100 of FIG. 2.
Figure 4:
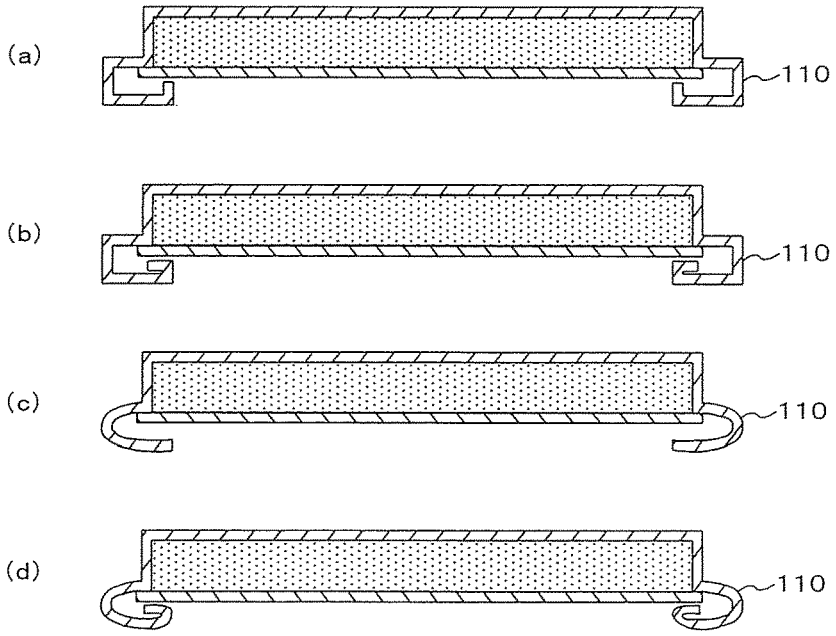
FIG. 4 is an explanatory diagram illustrating another embodiment of a flange portion 110 of FIG. 2.

FIG. 1 is a plan-view diagram illustrating a metal roofing member 1 according to Embodiment 1 of the present invention, and FIG. 2 is a cross-sectional diagram along line II-II in FIG. 1. FIG. 3 is an explanatory diagram illustrating another embodiment of a body portion 100 of FIG. 2, and FIG. 4 is an explanatory diagram illustrating another embodiment of a flange portion 110 of FIG. 2.

The metal roofing member 1 illustrated in FIG. 1 and FIG. 2 is disposed side by side with another metal roofing member, on a roof base of a building such as a house. As depicted in particular in FIG. 2, the metal roofing member 1 has a front substrate 10, a rear substrate 11 and a core material 12.

The front substrate 10, made from a metal sheet, is a member that appears on the outside of a roof when the metal roofing member 1 is disposed on a roof base.

As the metal sheet being the material of the front substrate 10 a hot-dip Zinc-based plated steel sheet, a hot-dip Al plated steel sheet, a hot-dip Zinc-based plated stainless steel sheet, a hot-dip Al plated stainless steel sheet, a stainless steel sheet, an Al sheet, a Ti sheet, a coated hot-dip Zinc-based plated steel sheet, a coated hot-dip Al plated steel sheet, a coated hot-dip Zinc-based plated stainless steel sheet, a coated hot-dip Al plated stainless steel sheet, a coated stainless steel sheet, a coated Al sheet or a coated Ti sheet can be used.

Preferably, the thickness of the metal sheet is 0.27 mm to 0.5 mm. A greater thickness of the metal sheet entails a stronger but also heavier roofing member. By setting the thickness of the metal sheet to be 0.27 mm or greater, it becomes possible to sufficiently secure the strength required from the roofing member, and sufficiently achieving wind pressure resistance and tread-down properties. By setting the thickness of the metal sheet to be 0.5 mm or smaller, it becomes possible to prevent the weight of the metal roofing member 1 from becoming excessive, and to keep down the total weight of the roof when equipment such as a solar cell module, a solar water heater, an air conditioner outdoor unit or snow melting equipment is provided on the roof.

The front substrate 10 is provided with a body portion 100 and a flange portion 110. The body portion 100 is a box-shaped portion having a top plate 101 and a side wall portion 102. The body portion 100 is preferably formed by performing drawing or bulging processing on a metal sheet. Other methods that can be resorted to for forming the box-shaped body portion 100 include for instance a method that involves bending a metal sheet having a shape such as the one illustrated in FIG. 3, along the dashed line in the figure. In a case where a metal sheet is formed to a box shape by bending, however, breaks appear between side wall portions 102, and water intrudes readily into the body portion 100. In a case, by contrast, where the box shape is formed by performing drawing or bulging processing, it becomes possible to make the side wall portion 102 into a wall surface that is continuous in the circumferential direction of the front substrate 10, and to reduce the likelihood of intrusion of water into the body portion 100.

In particular, the hardness of the side wall portion 102 is increased by work hardening, during formation of the body portion 100 by drawing or bulging processing, in a case where a steel sheet (hot-dip Zinc-based plated steel sheet, a hot-dip Al plated steel sheet, a hot-dip Zinc-based plated stainless steel sheet, a hot-dip Al plated stainless steel sheet, a stainless steel sheet, an Al sheet, a Ti sheet, a coated hot-dip Zinc-based plated steel sheet, a coated hot-dip Al plated steel sheet, a coated hot-dip Zinc-based plated stainless steel sheet, a coated hot-dip Al plated stainless steel sheet or a coated stainless steel sheet) is used as the metal sheet of the front substrate 10. Specifically, the Vickers hardness of the side wall portion 102 can be increased to about 1.4 to 1.6 times the hardness before working. The wind pressure resistance performance of the metal roofing member 1 is significantly enhanced by virtue of the fact that the side wall portion 102 is set to constitute a wall surface that is continuous in the circumferential direction of the front substrate 10, as described above, and by virtue of the fact that the hardness of the side wall portion 102 is increased by work hardening. The term wind pressure resistance performance denotes performance to the effect that the metal roofing member 1 resists strong wind without buckling.

The flange portion 110 extends from the body portion 100. As illustrated in FIG. 1, the flange portion 110 is formed over the entire circumference of the body portion 100. Warping of the front substrate 10 caused by strain generated in the metal sheet as a result of drawing or bulging processing can be avoided by virtue of the fact that the flange portion 110 is provided integrally with the body portion 100.

Preferably, an extension width t1 of the flange portion 110 from the body portion 100 is 2 mm to 5 mm. By prescribing the extension width t1 to be 2 mm or greater, it becomes possible to impart sufficient strength to the flange portion 110 and to prevent more reliably warping of the front substrate 10. By prescribing the extension width t1 to be 5 mm or smaller, it becomes possible to avoid drops in the strength of the flange portion 110 derived from an increase in the extension width t1, and to maintain satisfactorily the design properties of the metal roofing member 1.

As depicted in particular in FIG. 2, the flange portion 110 is formed by folding back, over the rear side of the front substrate 10, of a metal sheet 111 that extends outwards of the body portion 100 from a lower edge of the body portion 100, in such a manner that the metal sheet 111 wraps around the rear substrate 11. That is, the rear substrate 11 becomes positioned further inward than a side end 114 of the flange portion 110.

A rear end 112 that comes in contact with the roof base is provided in the fold-back portion of the flange portion 110. A distance t2 between the rear end 112 provided in the flange portion 110 and a rear surface 11*a* of the rear substrate 11 is set to 1 mm to 4 mm. Intrusion of water between the rear end 112 and the rear surface 11*a*, on account of capillarity, can be avoided herein by virtue of the fact that the distance t2 between the rear end 112 and a rear surface 11*a* is set to 1 mm or greater. Moreover, drops in the strength of the flange portion 110 can be avoided by virtue of the fact that the distance t2 between the rear end 112 and the rear surface 11*a* is set to 4 mm or smaller. Thanks to the fact that the distance t2 between the rear end 112 and the rear surface 11*a* is set to 4 mm or smaller, it becomes possible to avoid significant pooling of water between flange portions 110, after butting of the flange portion 110 with the flange portion 110 of another metal roofing member 1, as described below, and thus the concern of corrosion can be allayed more readily.

The outer edge 113 of the metal sheet that makes up the front substrate 10 includes the flange portion 110. The outer edge 113 is positioned further inward than the side end 114 of the flange portion 110. Although the outer edge 113 is often not coated or plated, the outer edge 113 can be prevented from being directly exposed to external corrosion factors, such as rainwater and sea salt particles, by virtue of the fact that the outer edge 113 is positioned further inward than the side end 114.

The shape of the fold-back portion of the flange portion 110 may be just one single fold, as illustrated in FIG. 2, or may involve repeated folding after fold-back, as illustrated in FIGS. 4(*a*) and 4(*b*). Further, fold-back of the flange portion 110 may be accomplished through 90°-bending, as illustrated in FIG. 2 and FIGS. 4(*a*) and 4(*b*), or may be accomplished through 180°-bending with constant curvature, as illustrated in FIGS. 4(*c*) and 4(*d*). Part of the flange portion 110 may be cut off, as needed, to an arbitrary shape before bending.

The radius of curvature of the bent portions of the metal sheet at the flange portion 110 is preferably set to 0.5 mm or greater, also in a case where fold-back of the flange portion 110 is performed through 90°-bending or 180°-bending. Setting the radius of curvature thus to be 0.5 mm or greater allows avoiding cracking of a coating film or a plating layer of the metal sheet, caused by bending, and to avoid corrosion of the metal sheet and delamination of the coating film or the plating layer.

The rear substrate 11 is a member disposed on the rear side of the front substrate 10, so as to cover an opening of the body portion 100. A lightweight material such as aluminum foil, aluminum metallized paper, aluminum hydroxide paper, calcium carbonate paper, a resin film or glass fiber paper, as the rear substrate 11. Increases in the weight of the metal roofing member 1 can be avoided by using such lightweight materials as the rear substrate 11.

The core material 12 is made from a foam resin and is filled in between the body portion 100 of the front substrate 10 and the rear substrate 11. By filling the space between the body portion 100 and the rear substrate 11 with a foam resin, it becomes possible to firmly bring the core material 12 into close contact with the interior of the body portion 100, to a greater degree than in an implementation where a backing material such as a resin sheet is affixed to the rear side of the front substrate 10, and it becomes possible to improve the performance required from the roofing member, for instance in terms of rain sound properties, heat insulation properties and tread-down resistance.

The material of the core material 12 is not particularly limited, and for instance a urethane, phenol or nurate resin can be used. In roofing members, however, it is essential to use an incombustibility-certified material. The test for incombustible material certification is a heat release test performed according to the cone calorimeter test method of ISO 5660-1. The thickness of the body portion 100 can be reduced, and inorganic foamed particles can be incorporated into the foam resin constituting the core material 12, in a case where the foam resin is for instance urethane, which has a large calorific value.

A height h of the body portion 100 filled with the core material 12 is preferably set to 4 mm to 8 mm. The strength of the body portion 100 can be sufficiently increased, and the wind pressure resistance enhanced, by prescribing the height h of the body portion 100 to be 4 mm or greater. Heat insulation properties improve also at 4 mm or greater. The organic mass of the core material 12 can be prevented from becoming excessive, and incombustible material certification can be obtained yet more reliably, by setting the height h of the body portion 100 to be 8 mm or smaller.

Figure 5:
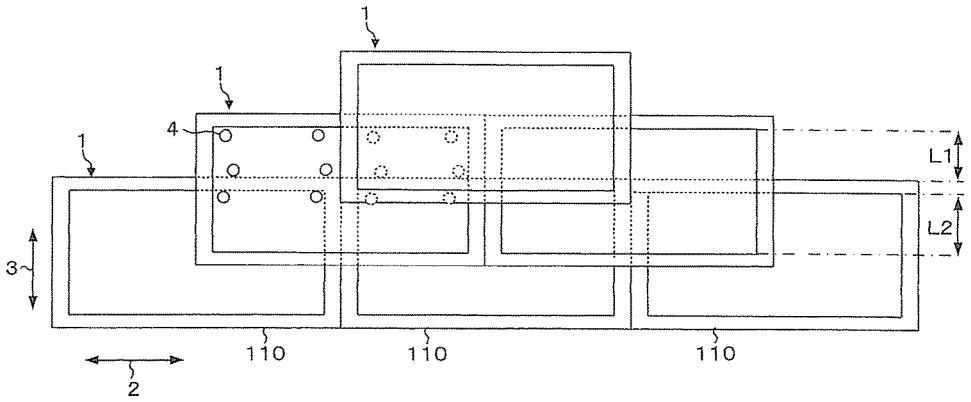
FIG. 5 is an explanatory diagram illustrating a roofing structure and a roofing method that utilize the metal roofing member illustrated in FIG. 1 and FIG. 2.
Figure 6:
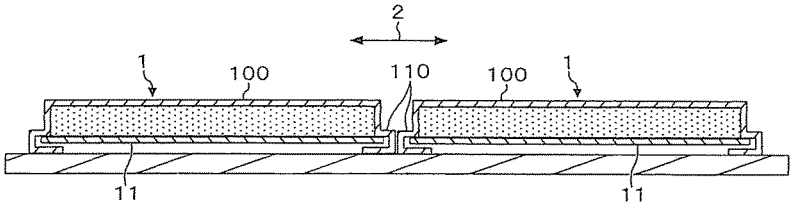
FIG. 6 is an explanatory diagram illustrating the relationship between two metal roofing members of FIG. 5 adjacent in a direction parallel to an eave.
Figure 7:
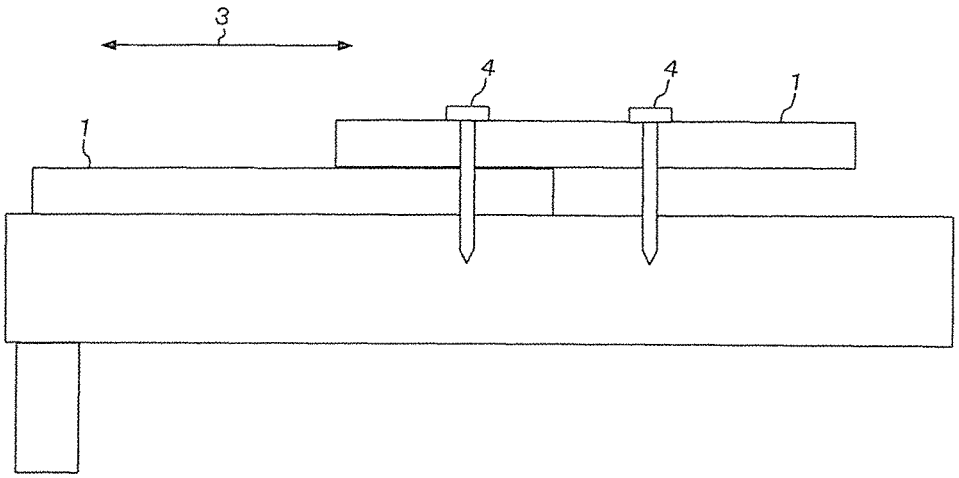
FIG. 7 is an explanatory diagram illustrating the relationship between two metal roofing members of FIG. 5 disposed offset from each other in an eave-ridge direction.

Next, FIG. 5 is an explanatory diagram illustrating a roofing structure and a roofing method that utilize the metal roofing member 1 illustrated in FIG. 1 and FIG. 2. FIG. 6 is an explanatory diagram illustrating the relationship between two metal roofing members 1 of FIG. 5 adjacent in a direction 2 parallel to an eave, and FIG. 7 is an explanatory diagram illustrating the relationship between two metal roofing members 1 of FIG. 5 that are disposed offset from each other in an eave-ridge direction 3.

As illustrated in FIG. 5, the metal roofing member 1 is disposed on a roof base while the flange portion 110 of the metal roofing member 1 butts a flange portion 110 of other metal roofing members 1. In further detail, a plurality of metal roofing members 1 are disposed side by side on the roof base, while respective flange portions 110 butt each other in the direction 2 parallel to the eave. The metal roofing members 1 are fixed to the roof base via stopping members 4 such as nails. In order to avoid an overly complex figure, the stopping members 4 are depicted in FIG. 5 only for one metal roofing member 1, while the stopping members 4 of other metal roofing members 1 are omitted in the figure.

Butting of the flange portions 110 against each other denotes herein a configuration where the flange portions 110 of adjacent metal roofing members 1 are in contact with each other, or a configuration where the flange portions 110 of adjacent metal roofing members 1 are brought close to each other. The metal roofing members 1 disposed side by side have an identical configuration. However, metal roofing members of some other configuration can be used at positions where conditions are different, such as at roof edges.

As illustrated in FIG. 6, the two metal roofing members 1 adjacent in the direction 2 parallel to the eave are in contact with or close to each other only at the flange portions 110. Accordingly, the region at which the two adjacent metal roofing members 1 are in contact with or close to each other is smaller than in a conventional configuration (with butting of side faces of box-shaped front substrates). This allows reducing water pooling between metal roofing members 1, and allaying the concern of corrosion.

Thanks to the fact that the metal roofing member 1 is provided with the flange portion 110, a clearance can be formed between the rear substrate 11 and the roof base, as illustrated in FIG. 6, the amount of water pooling on the rear side of the metal roofing member 1 can be reduced, and the concern of corrosion can be further allayed.

The plurality of metal roofing members 1 are disposed on the roof base while eave-side end sections of ridge-side metal roofing members 1 overlap ridge-side end sections of eave-side metal roofing members 1, in the eave-ridge direction 3. At least one of the stopping members 4 is driven so as to run through both the eave-side metal roofing members 1 and ridge-side metal roofing members 1. By driving of the stopping members 4 so as to run through both the eave-side metal roofing members 1 and ridge-side metal roofing members 1, it becomes possible to arrange ridge-side metal roofing members 1 substantially parallelly to the eave-side metal roofing members 1, as illustrated in FIG. 7, and to reduce lifting of the eave-side end sections of the ridge-side metal roofing members 1. Watertightness of the roof can be enhanced by reducing the lifting of the eave-side end sections of the ridge-side metal roofing members 1.

As illustrated in FIG. 5, a length L2 over which the body portions 100 of metal roofing members 1 overlap each other in the eave-ridge direction 3 is greater than a length L1 over which the body portions 100 of ridge-side metal roofing members 1 do not overlap eave-side metal roofing members 1 (L2>L1). As a result, the stopping members 4 can be driven so as to run through both the eave-side metal roofing members 1 and ridge-side metal roofing members 1 over a wider region.

Examples are illustrated next. The inventors experimentally produced test members of the metal roofing member 1 under the conditions given below.

Herein a 0.20 mm to 0.8 mm coated hot-dip Zn-55% Al plated steel sheet, a coated hot-dip Zn-6% Al-3% Mg plated steel sheet or a coated hot-dip Al plated steel sheet was used as the material of the front substrate 10.

Herein 0.2 mm glass fiber paper, 0.2 mm Al metallized paper, a 0.2 mm PE resin film, a 0.1 mm Al foil or a 0.27 mm coated hot-dip Zinc-based plated steel sheet was used as the rear substrate 11.

A foam resin of two-liquid mixture type was used as the core material 12. The mixing ratio of a polyol component and isocyanate, phenol or nurate component was set to 1:1, in ratio by weight.

The front substrate 10 was worked to a predetermined thickness and shape of the roofing member. Thereafter, the rear substrate 11 was disposed on the rear side of the front substrate 10 so as to cover the opening of the body portion 100, and a foam resin was injected into the gap between the body portion 100 of the front substrate 10 and the rear substrate 11, using a commercially available high-pressure injection machine. Resin foaming was accomplished by holding for 2 minutes in a mold, the temperature of which was adjusted to 70° C. by hot water circulation; thereafter, the roofing member was removed from the mold, and was allowed to stand for 5 minutes under conditions of room temperature of 20° C., to complete foaming of the resin.

Completion of the resin foaming was followed by cutting of the metal sheet 111 extending outwards of the of the body portion 100 from a lower edge of the body portion 100 in such a manner that the width of which flange portion 110 was 5 mm, and bending the same to have a predetermined shape with a bender. The dimensions of the final metal roofing member 1 were set to 414 mm×910 mm. The thickness of the final roofing member was set to lie in the range of 3 mm to 8 mm.

For comparison, a specimen of a metal roofing member (conventional configuration) was produced through inward 90°-bending of the four sides of a 0.3 mm coated hot-dip Zn-55% Al alloy plated steel sheet as the front substrate, using a bender, to yield a box shape, followed by injection of a foam resin in accordance with the above-described method. Herein 0.2 mm glass fiber paper was used as the rear substrate of this metal roofing member. The thickness dimension of the roofing member was set to 6 mm, while other conditions were set to be identical to the conditions above.

For comparison, there were tested also a metal roofing member having no foam resin injected thereinto, a roofing member obtained by bonding a commercially available 0.3 mm thermally-insulating polyethylene sheet, by way of an adhesive, to a worked front substrate, and also a 6 mm thick concrete tile, a 16 mm thick clay roof tile, and a metal roofing member of mating type that utilized a coated hot-dip Zn-55% Al alloy plated steel sheet (without backing material) having a thickness of 0.35 mm.

The inventors used the above test members to evaluate (1) the weight of the roofing member, (2) the flexural strength of the roofing member, (3) the warp amount of the roofing member, (4) rainwater pooling, (5) corrosion resistance and (6) heat insulation properties. The results are given in the table below.

TABLE 1

| Evaluation results | | | | | | | | | | | |
|---|---|---|---|---|---|---|---|---|---|---|---|
| | | Details of test member | | | | | | | | | |
| | | | | | | Front | | Flange bent portion | | | |
| No. | Class | Roofing member (mm) | Core (resin) type | Front substrate type (note 1) | Front substrate thickness (mm) | substrate forming method (note 4) | Rear substrate type (note 2) | Bent portion shape (note 3) | Bent portion width: $t_1$ (mm) | Bent portion height: $t_2$ (mm) | Bending R (mm) |
| 1 | Example | 4 | Urethane | A | 0.27 | (A) | a | (*) | 2.0 | 4.0 | 0.5 |
| 2 | | 4 | Urethane | A | 0.27 | (A) | a | (a) | 2.5 | 3.0 | 0.7 |
| 3 | | 6 | Nurate | B | 0.30 | (A) | b | (b) | 3.0 | 3.0 | 1.0 |
| 4 | | 6 | Nurate | C | 0.30 | (A) | c | (c) | 3.5 | 2.0 | 0.9 |
| 5 | | 8 | Nurate | A | 0.40 | (A) | d | (d) | 4.0 | 2.0 | 0.9 |
| 6 | | 8 | Phenol | A | 0.50 | (B) | a | (d) | 5.0 | 1.0 | 1.0 |
| 7 | Comparative example | 6 | Nurate | A | 0.35 | — | a | Bender bending/box-like roof (conventional configuration) | | | |
| 8 | | 6 | Nurate | A | 0.25 | (A) | a | (*) | 3.5 | 2.0 | 2.0 |
| 9 | | 6 | Nurate | A | 0.60 | (A) | a | (*) | 0.9 | 2.0 | 0.9 |
| 10 | | 6 | Urethane | B | 0.30 | (A) | b | (*) | 1.9 | 2.0 | 1.0 |

TABLE 1-continued

| Evaluation results | | | | | | | | | | |
|---|---|---|---|---|---|---|---|---|---|---|
| 11 | 6 | Urethane | B | 0.30 | (B) | b | (*) | 6.0 | 2.0 | 1.0 |
| 12 | 6 | Urethane | B | 0.27 | (A) | e | (*) | 3.0 | 3.0 | 1.0 |
| 13 | 6 | Nurate | C | 0.25 | (B) | a | (*) | 3.5 | 0.25 | 0.25 |
| 14 | 6 | Nurate | C | 0.35 | (A) | a | (*) | 3.5 | 5.0 | 1.0 |
| 15 | 3 | Nurate | C | 0.40 | (A) | a | (*) | 3.5 | 2.0 | 1.0 |
| 16 | 6 | Nurate | C | 0.35 | (A) | a | (*) | 3.5 | 0.95 | 0.4 |
| 17 | 6 | No core | C | 0.35 | (A) | a | (c) | 3.5 | 2.0 | 1.0 |
| 18 | 6 | Adhesive-bonded thermally-Insulating polyethylene sheet | C | 0.35 | (A) | a | (d) | 3.5 | 2.0 | 1.0 |
| 19 | Concrete tile (thickness: 6 mm) | | | | | | | | | |
| 20 | Clay roof tile (thickness: 16 mm) | | | | | | | | | |
| 21 | Metal roof of mating type | | | | | | | | | |

| | | | | Rainwater pooling evaluation | | Corrosion resistance evaluation | | |
|---|---|---|---|---|---|---|---|---|
| No. | Roofing member weight evaluation | Flexural strength evaluation | Warp amount evaluation | Gap at joints between roofing member | Gap between roofing member/roof base | Gap at joints between roofing member | Gap between roofing member/roof base | Heat insulation evaluation |
| 1 | ○ | ○ | ○ | ○ | ○ | ○ | ○ | ○ |
| 2 | ○ | ○ | ○ | ○ | ○ | ○ | ○ | ○ |
| 3 | ○ | ○ | ○ | ○ | ○ | ○ | ○ | ○ |
| 4 | ○ | ○ | ○ | ○ | ○ | ○ | ○ | ○ |
| 5 | ○ | ○ | ○ | ○ | ○ | ○ | ○ | ○ |
| 6 | ○ | ○ | ○ | ○ | ○ | ○ | ○ | ○ |
| 7 | ○ | X | Δ | X | X | X | X | ○ |
| 8 | ○ | X | ○ | ○ | ○ | ○ | ○ | ○ |
| 9 | X | X | ○ | ○ | ○ | ○ | ○ | ○ |
| 10 | ○ | X | ○ | ○ | ○ | ○ | ○ | ○ |
| 11 | ○ | X | ○ | ○ | ○ | ○ | ○ | ○ |
| 12 | X | ○ | ○ | ○ | ○ | ○ | ○ | ○ |
| 13 | ○ | Δ | ○ | ○ | X | X | X | ○ |
| 14 | ○ | Δ | ○ | X | ○ | X | ○ | ○ |
| 15 | ○ | X | ○ | ○ | ○ | ○ | ○ | Δ |
| 16 | ○ | ○ | ○ | ○ | Δ | X | Δ | ○ |
| 17 | ○ | X | X | ○ | ○ | ○ | ○ | X |
| 18 | ○ | Δ | X | ○ | ○ | ○ | ○ | Δ |
| 19 | X | ○ | ○ | — | — | — | — | ○ |
| 20 | X | ○ | — | — | — | — | — | ○ |
| 21 | ○ | X | ○ | — | — | — | — | X |

(note 1)
A: coated hot-dip Zn-55% Al plated steel sheet; B: coated hot-dip Zn-6% Al-3% Mg plated steel sheet; C: coated hot-dip Al plated steel sheet
(note 2)
a: glass fiber paper; b: Al metallized paper; c: resin film; d: Al foil; e: coated hot-dip Zinc-based plated steel sheet
(note 3)
(*) shape of the flange bent portion of FIG. 2; (a) to (d) shape of flange bent portion of FIG. 4
(note 4)
(A) forming to a box shape by drawing or bulging processing illustrated In FIG. 1; (B) forming to a box shape by bending illustrated in FIG. 3
—: test not performed (1) Evaluation Criteria of Roofing Member Weight The unit weight of the roofing members was measured and evaluated in accordance with the criteria below. The evaluation envisaged installation of a standard 130 N/m$^2$ solar cell module on the roof, using the following evaluation criteria based on the weight of the roof as a whole including the roofing member.

O: unit weight of roofing member being smaller than 250 N/m$^2$ x: unit weight of roofing member being 250 N/m$^2$ or greater (2) Measurement and Evaluation Criteria of Flexural Strength of the Roofing Member The roofing member was placed on a pair of rod-like members disposed spaced apart from each other by 450 mm, taking the extension direction of the rod-like members as the transverse direction, and a maximum load was measured using an Autograph, with the positions of the rod-like members as points of support and the intermediate position of the rod-like members as the point of effort.

The flexural strength of the roofing member was evaluated in accordance with the following criteria.

O: maximum load of 160 N or greater

Δ: maximum load smaller than 160 Nmm and 50 N or greater x: maximum load smaller than 50 N (3) Evaluation of the Warp Amount of the Roofing Member The roofing member was placed on a platen, the distance from the tips at the four sides of the roofing member to the platen was measured, and the maximum value obtained was taken as the warp amount.

The warp amount of the roofing member was evaluated in accordance with the criteria below.

O: warp amount smaller than 5 mm

Δ: warp amount from 5 mm to less than 10 mm x: warp amount of 10 mm or greater (4) Evaluation Method and Evaluation Criteria of Rainwater Pooling A commercially available waterproof sheet was affixed to the surface of a roofing boards (thickness 12 mm), and a simulated roof was produced, with four tiers of roofing members, in accordance with overlay roofing illustrated in FIG. 5, at an inclination angle set to 30°. The entire simulated roof was sprayed with tap water for 10 minutes, to thoroughly soak the whole roof. Next, the simulated roof was dried for 5 hours in a constant-temperature room at room temperature of 20° C. The clearance between roofing members (vertical connecting portion) in the ridge-eave direction was observed visually, and the dry state was evaluated. The roofing members were then stripped, the dry state of the rear substrate side of the roofing member and of the waterproof sheet surface were visually observed and evaluated.

The dry state was evaluated in accordance with the criteria below.

O: sufficient drying with virtually no observable wetting

Δ: slight wetting observed x: no drying; and wetting observed (5) Evaluation Method and Evaluation Criteria of Corrosion Resistance A roof obtained by overlay roofing was envisaged herein in the form of a simulated roof produced with three tiers of roofing members, in accordance with the overlay roofing operation illustrated in FIG. 5. A combined cycle corrosion test (1 cycle: 5% salt spray at 35 degrees for 1 hour→50° C.; drying for 4 hours→wetting for 3 hours at 98% RH, 50° C.) in accordance with Japanese Industrial Standard Z 2371 was performed over 200 cycles, after which the corrosion state of the butting portion of two metal roofing members 1 adjacent in the direction 2 parallel to the eave was observed visually. The front substrate 10 of the metal roofing members 1 was stripped off, and the corrosion state of the rear side of the front substrate 10 was observed.

Corrosion resistance was evaluated in accordance with the following criteria.

O: virtually no corrosion observed

Δ: slight corrosion observed x: significant corrosion observed (6) Evaluation Method and Evaluation Criteria of Heat Insulation Properties Thermocouples were attached to the rear surface of roofing boards and the front substrate surface of a simulated roof in which rainwater pooling had been evaluated. Twelve lamps (100/110 V, 150 W) were disposed evenly distributed at positions located 180 mm from the surface of this simulated roof. The temperature of the rear of the roofing boards after 1 hour or irradiation at a lamp output of 60% was measured by the thermocouples, to evaluate heat insulation properties.

Heat insulation properties were rated according to the following criteria.

O: temperature of the rear of the roofing board lower than 50° C.

Δ: temperature of the rear of the roofing board from 50° C. to 55° C.

x: temperature of the rear of the roofing board of 55° C. or higher

In the case of Nos. 13 and 16 in Table 1, in which the distance t2 between the rear end 112 of the flange portion 110 and the rear surface of the rear substrate 11 was smaller than 1 mm, rainwater pooled up in the clearance part between the rear substrate 11 and the roof base. The corrosion resistance of the front substrate positioned underneath was impaired as a result. The distance t2 in No. 13 is 0.25 mm identical to the thickness of the front substrate 10. That is, the structure has the rear substrate 11 crimped and hugged by the front substrate 10.

In the case of No. 14 where the distance t2 exceeded 4 mm, flexural strength was low, rainwater pooled at clearance parts between roofing members, and corrosion resistance was impaired.

These results confirmed the superiority of prescribing the distance t2 between the rear end 112 of the flange portion 110 and the rear surface of the rear substrate 11 to be 1 mm to 4 mm.

In Nos. 9 and 10, the extension width t1 of the flange portion 110 from the body portion 100 was smaller than 2 mm, and flexural strength was insufficient. In No. 11 the extension width t1 exceeded 5 mm, and flexural strength was low. These results confirmed the superiority of setting the extension width t1 of the flange portion 110 from the body portion 100 to 2 mm to 5 mm.

The thickness of the front substrate in Nos. 8 and 13 was smaller than 0.27 mm, and accordingly flexural strength was insufficient. The thickness of the front substrate in No. 9 exceeded 0.5 mm, and the evaluation of the roofing member weight was poor (x). These results confirmed the superiority of a range of 0.27 mm to 0.5 mm of the thickness of the metal sheet that makes up the front substrate 10.

In the case of Nos. 13 and 16, where the radius of curvature was smaller than 0.5 mm, the front substrate 10 was a coated hot-dip Al plated steel sheet, and accordingly cracks appeared in the coating film and the plating layer, as a result of which the evaluation rating of corrosion resistance was poor due to the occurrence of corrosion at joints between the roofing members. These results confirmed the superiority of setting the radius of curvature of the bent portion of the metal sheet to be 0.5 mm or greater when using a metal sheet having a coating film and/or a plating layer.

The thickness of the body portion 100 (roofing member) in No. 3 was smaller than 4 mm, and as a result the evaluation of the flexural strength was poor (x). Heat insulating performance was slightly lowered and evaluated as (Δ). These results confirmed the superiority of setting the height of the body portion 100 to be 4 mm or greater. Although not particularly set out in Table 1, the organic mass of the core material 12 can be prevented from becoming excessive, and incombustible material certification can be obtained yet more reliably, by setting the height h of the body portion 100 to be 8 mm or smaller.

The rear substrate 11 of No. 12, being a coated hot-dip Zinc-based plated steel sheet, was not lightweight, and accordingly the evaluation of roofing member weight was poor. This result confirmed the superiority of using a lightweight material such as aluminum foil, aluminum metallized paper, aluminum hydroxide paper, calcium carbonate paper, a resin film or glass fiber paper as the rear substrate 11.

In the case of No. 17 having no core material, unfavorable evaluation results—poor warp, lack of flexural strength, and significantly poor heat insulation properties, were obtained.

The flexural strength in No. 18, in which a 0.3 mm thermally-insulating polyethylene sheet was bonded via an adhesive, was evaluated as fair (A), and heat insulation properties as slightly poor.

The concrete tile in No. 19 and the clay roof tile in No. 20 yielded a poor evaluation of roofing member weight.

The conventional metal roof of mating type in No. 21 exhibited poor flexural strength and also poor heat insulation properties, since no foam resin had been injected.

The inventors carried out a wind pressure resistance test on the roofing members in accordance with Japanese Industrial Standard A 1515. Specifically, a dynamic wind pressure tester was used to observe the occurrence or absence of breakage in a test specimen when pressed in a pressing process.

Herein a 0.27 mm thick coated hot-dip Zn-55% Al plated steel sheet and a 0.5 mm thick aluminum sheet were used as the material of the front substrate 10. The body portion 100 was produced by performing bulging processing on these materials. Glass fiber paper as the rear substrate 11 was disposed on the rear side of the front substrate 10 so as to cover the opening of the body portion 100, and a nurate resin was injected into the gap between the front substrate 10 and the rear substrate 11, using a commercially available injection machine. Resin foaming was accomplished by holding for 2 minutes in a mold, the temperature of which was adjusted to 70° C. by hot water circulation; thereafter, the roofing member was removed from the mold, and was allowed to stand for 5 minutes under conditions of temperature of 20° C., to complete foaming of the resin. The thickness of the roofing member was set to 5 mm. Next, the metal sheet 111 extending outwards of the body portion 100 from a lower edge of the body portion 100 was cut so that the width of the flange portion 110 was 5 mm, and the metal sheet 111 was worked to the bent shape of FIG. 4(*a*) using a bender; herein bent portion width $t_1$ was set to 3.0 mm, a bending height $t_2$ was set to 3.0 mm and bending R was set to 1.0 mm.

Wind pressure resistance was evaluated on the basis of the breaking pressure at the time of induced breakage. In a case where a 0.27 mm thick coated hot-dip Zn-55% Al plated steel sheet was used as the material of the front substrate 10, the breaking pressure was a negative pressure of 6,000 N/m$^2$ or greater, whereas in a case where a 0.5 mm thick aluminum sheet was used as the material of the front substrate 10, the breaking pressure was a negative pressure in the range of 5,000 N/m$^2$ to less than 6,000 N/m$^2$. That is, it was found that good wind pressure resistance can be achieved also with an aluminum sheet, and that yet better wind pressure resistance can be achieved when using a steel sheet. Work hardening of the side wall portion 102 derived from bulging is more pronounced in a steel sheet than in an aluminum sheet; it is deemed that this difference in hardness of the side wall portion 102 underlies the difference in evaluation results in the wind pressure resistance test.

In such a metal roofing member 1, and the roofing structure and roofing method that utilize the metal roofing member 1, the metal roofing members are configured so that the flange portion 110 is disposed on the roof base butting the flange portion 110 of another metal roofing member 1, as a result of which a gap is formed between the body portion 100 and the body portion 100 of the other metal roofing member 1. Therefore, this allows reducing water pooling between metal roofing members, and allaying the concern of corrosion.

Further, the body portion 100 is formed by performing drawing or bulging processing on a metal sheet, and hence it becomes possible to configure the side wall portion 102 as a series of wall surfaces, and to reduce the likelihood of intrusion of water into the body portion 100. In this configuration, warping of the front substrate 10 caused by strain generated in the metal sheet as a result of drawing or bulging processing can be avoided by virtue of the fact that the flange portion 110 is provided integrally with the body portion 100.

Further, the extension width t1 of the flange portion 110 from the body portion 100 is 2 mm to 5 mm, and hence the flange portion 110 can be imparted with sufficient strength, and the design properties of the metal roofing member 1 can be maintained satisfactorily.

The metal sheet being the material of the front substrate 10 is made of a hot-dip Zinc-based plated steel sheet, a hot-dip Al plated steel sheet, a hot-dip Zinc-based plated stainless steel sheet, a hot-dip Al plated stainless steel sheet, a stainless steel sheet, an Al sheet, a Ti sheet, a coated hot-dip Zinc-based plated steel sheet, a coated hot-dip Al plated steel sheet, a coated hot-dip Zinc-based plated stainless steel sheet, a coated hot-dip Al plated stainless steel sheet, a coated stainless steel sheet, a coated Al sheet or a coated Ti sheet. Therefore, the concern of corrosion of the metal roofing member can be allayed more reliably.

Further, the thickness of the metal sheet that makes up the front substrate 10 is 0.27 mm to 0.5 mm, and accordingly the strength required as a roofing member can be sufficiently secured, and the weight of the metal roofing member 1 is prevented from becoming excessively large. Such a configuration is particularly useful when equipment such as a solar cell module, a solar water heater, an air conditioner outdoor unit or snow melting equipment is provided on the roof.

Further, the bent portion of the metal sheet included in the flange portion 110 has a radius of curvature set to 0.5 mm or greater, and hence it becomes possible to avoid the occurrence of cracks in the coating film and the plating layer of the metal sheet, caused by bending, and to avoid corrosion of the metal sheet more reliably.

Further, the body portion 100 is formed by drawing or bulging processing on a metal sheet, and is made of a hot-dip Zinc-based plated steel sheet, a hot-dip Al plated steel sheet, a hot-dip Zinc-based plated stainless steel sheet, a hot-dip Al plated stainless steel sheet, a stainless steel sheet, an Al sheet, a Ti sheet, a coated hot-dip Zinc-based plated steel sheet, a coated hot-dip Al plated steel sheet, a coated hot-dip Zinc-based plated stainless steel sheet, a coated hot-dip Al plated stainless steel sheet or a coated stainless steel sheet. Therefore, the hardness of the side wall portion 102 can be enhanced by work hardening, and better wind pressure resistance performance can be achieved.

The height h of the body portion 100 is set to 4 mm to 8 mm, and hence incombustible material certification can be obtained more reliably while securing heat insulation properties and strength.

Moreover, the weight of the metal roofing member 1 can be prevented from being excessively large, since the rear substrate 11 is made from aluminum foil, aluminum metallized paper, aluminum hydroxide paper, calcium carbonate paper, a resin film or glass fiber paper.

The invention claimed is:

1. A metal roofing member disposed side by side with another metal roofing member on a roof base, the metal roofing member comprising:

a front substrate made of a metal sheet, and comprising a box-shaped body portion and a flange portion extending from the body portion;

a rear substrate disposed on a rear side of the front substrate, so as to cover an opening of the body portion; and a core material comprising a foam resin and filled in between the body portion of the front substrate and the rear substrate, wherein the flange portion is formed by folding back, over the rear side of the front substrate, the metal sheet extending outwards from a sidewall of the body portion in a direction away from the core material and perpendicular to a height direction of the body portion, from a lower edge of the body portion, such that the metal sheet wraps around the rear substrate;

wherein the flange portion comprises a rear end configured to contact the roof base;

wherein the distance between the rear end of the flange portion and the rear surface of the rear substrate is set to 1 mm to 4 mm; and wherein the flange portion is configured to be disposed on the roof base while butting against a flange portion of the other metal roofing member.

2. The metal roofing member according to claim 1, wherein the body portion is formed by performing drawing or bulging on the metal sheet.

3. The metal roofing member according to claim 1, wherein an extension width of the flange portion from the body portion is 2 mm to 5 mm.

4. The metal roofing member according to claim 1, wherein the metal sheet, which is a material of the front substrate, is made of a hot-dip Zinc-based plated steel sheet, a hot-dip Al plated steel sheet, a hot-dip Zinc-based plated stainless steel sheet, a hot-dip Al plated stainless steel sheet, a stainless steel sheet, an Al sheet, a Ti sheet, a coated hot-dip Zinc-based plated steel sheet, a coated hot-dip Al plated steel sheet, a coated hot-dip Zinc-based plated stainless steel sheet, a coated hot-dip Al plated stainless steel sheet, a coated stainless steel sheet, a coated Al sheet or a coated Ti sheet.

5. The metal roofing member according to claim 4, wherein the thickness of the metal sheet that makes up the front substrate is 0.27 mm to 0.5 mm.

6. The metal roofing member according to claim 4, wherein the radius of curvature of a bent portion of the metal sheet included in the flange portion is set to 0.5 mm or greater.

7. The metal roofing member according to claim 1, wherein the body portion is formed by performing drawing or bulging processing on the metal sheet; and the metal sheet, which is a material of the front substrate, is made of a hot-dip Zinc-based plated steel sheet, a hot-dip Al plated steel sheet, a hot-dip Zinc-based plated stainless steel sheet, a hot-dip Al plated stainless steel sheet, a stainless steel sheet, an Al sheet, a Ti sheet, a coated hot-dip Zinc-based plated steel sheet, a coated hot-dip Al plated steel sheet, a coated hot-dip Zinc-based plated stainless steel sheet, a coated hot-dip Al plated stainless steel sheet or a coated stainless steel sheet.

8. The metal roofing member according to claim 1, wherein the height of the body portion is set to 4 mm to 8 mm.

9. The metal roofing member according to claim 1, wherein the rear substrate is made from aluminum foil, aluminum metallized paper, aluminum hydroxide paper, calcium carbonate paper, a resin film or glass fiber paper.

10. A roofing structure comprising a plurality of metal roofing members, each metal roofing member comprising:

a front substrate made of a metal sheet, and comprising a box-shaped body portion and a flange portion extending from the body portion;

a rear substrate disposed on a rear side of the front substrate, so as to cover an opening of the body portion; and a core material made from a foam resin and filled in between the body portion of the front substrate and the rear substrate, wherein the flange portion is formed by folding back, over the rear side of the front substrate, the metal sheet extending outwards from a sidewall of the body portion in a direction away from the core material and perpendicular to a height direction of the body portion, from a lower edge of the body portion, such that the metal sheet wraps around the rear substrate, wherein the flange portion comprises a rear end configured to contact a roof base, and wherein the distance between the rear end of the flange portion and the rear surface of the rear substrate being set to 1 mm to 4 mm, wherein the plurality of metal roofing members are disposed side by side on the roof base, while the flange portion of each metal roofing member is configured to butt each other.

11. A roofing method, comprising:

using a plurality of metal roofing members, each metal roofing member comprising:

a front substrate made of a metal sheet, and provided with a box-shaped body portion and a flange portion extending from the body portion;

a rear substrate disposed on the rear side of the front substrate, so as to cover an opening of the body portion; and a core material made from a foam resin and filled in between the body portion of the front substrate and the rear substrate, wherein the flange portion is formed by folding back, over the rear side of the front substrate, the metal sheet extending outwards from a sidewall of the body portion in a direction away from the core material and perpendicular to a height direction of the body portion, from a lower edge of the body portion, such that the metal sheet wraps around the rear substrate, wherein the flange portion being provided with a rear end that comes in contact with a roof base, and wherein the distance between the rear end of the flange portion and the rear surface of the rear substrate being set to 1 mm to 4 mm; and arranging the plurality of metal roofing members side by side on the roof base, while causing the flange portion of each metal roofing member to butt each other.

12. The metal roofing member of claim 1, wherein the front substrate comprises a top plate extending from the sidewall in the direction perpendicular to the height direction of the body portion.

13. The metal roofing member of 1, wherein the side wall of the body portion is continuous in a circumferential direction of the front substrate.

14. The metal roofing member of claim 13, wherein a hardness of the side wall is increased by drawing or bulging processing the metal sheet.

15. The metal roofing member of claim 14, wherein a Vicker hardness of the side wall is increased to 1.4 to 1.6 times from the drawing or bulging processing of the metal sheet.

* * * * *